United States Patent [19]

Pylant et al.

[11] 4,084,503

[45] Apr. 18, 1978

[54] PRINTER APPARATUS

[75] Inventors: John D. Pylant, Irvine; Paul R. Lozeau, Placentia; Newton R. Packard, Los Alamitos, all of Calif.

[73] Assignee: Sheldon-Sodeco Printer, Inc., Elmsford, N.Y.

[21] Appl. No.: 754,859

[22] Filed: Dec. 27, 1976

Related U.S. Application Data

[63] Continuation of Ser. No. 572,067, Apr. 28, 1975, abandoned.

[51] Int. Cl.[2] ..... B41J 7/70

[52] U.S. Cl. ..... 101/96; 101/100; 101/107; 101/93.04; 101/337; 197/168

[58] Field of Search .... 101/93.04, 93.08, 93.28–93.36, 101/96, 228, 100, 101, 107, 110, 336; 197/168, 151, 156, 158, 1 R, 1 A, 127, 133 R, 138

[56] References Cited

U.S. PATENT DOCUMENTS

| | | | |
|---|---|---|---|
| 2,699,857 | 1/1955 | Wales | 101/100 X |
| 3,283,702 | 11/1966 | Higgins et al. | 101/93.04 |
| 3,317,017 | 5/1967 | Young | 101/93.04 X |
| 3,625,142 | 12/1971 | Bresler | 101/93.04 |
| 3,731,622 | 5/1973 | Baranoff | 101/93.29 X |
| 3,735,700 | 5/1974 | Roser | 101/228 |
| 3,804,008 | 4/1974 | Hoyer | 101/93.04 |
| 3,835,770 | 9/1974 | Shimodaira | 101/100 X |
| 3,845,850 | 11/1974 | Herr et al. | 101/93.04 X |
| 3,871,507 | 3/1975 | Perry et al. | 197/168 X |

OTHER PUBLICATIONS

Owen, "Reversible Endless Tape Cassette", IBM Tech. Discl. Bulletin, vol. 13, No. 11, 4/1971, p. 3324.

*Primary Examiner*—Edward M. Coven
*Attorney, Agent, or Firm*—Kane, Dalsimer, Kane, Sullivan and Kurucz

[57] ABSTRACT

High speed, on-the-fly line printer apparatus including an inked ribbon advancing mechanism, a print sheet advancing mechanism, and drive structure coupled with both the advancing mechanisms to interruptedly advance them. Also, the inked ribbon advancing mechanism may be bodily shiftable between different positions associated with different color printing modes, the drive structure accommodating such shifting. Furthermore, a drum having multiple columns of type font segments is provided.

16 Claims, 17 Drawing Figures

2
2
10
11
11a
12
15
16
17a
18
20
23
25
26
27
27'
28
33
33a
38
39
40
41
42
43
44
44'
45
46
47
50
50a
51
54
56
56a
63
65
73
75'
76'
77'
81
82
86
87
96
97
100
101
102
103
104
105
190
191
192

11
11
6
6
7
7

PRINTER APPARATUS

This is a continuation of application Ser. No. 572,067 filed Apr. 28, 1975, now abandoned.

BACKGROUND OF THE INVENTION

This invention relates generally to high speed, on-the-fly line printers, one example of which is described in U.S. Pat. No. 3,850,097. More particularly, the invention concerns unusually advantageous electromechanical mechanism enabling the structuring of such printers in highly compact simple, and malfunction-free form.

There is a continuing need for electromechanical line printers characterized by high-speed, malfunction-free operation as well as simplicity, ruggedness and low cost, highly compact design. No prior printers of which we are aware meet all these needs and with the unusual advantages as are now afforded by the present invention.

SUMMARY OF THE INVENTION

It is a major object of the present invention to provide an on-the-fly printer overcoming disadvantages of prior devices and meeting the needs as described above. Basically, the printer apparatus is operable to rapidly print characters in lines and columns on a print sheet, and comprises:

(a) a frame, (b) a rotary drum carried by the frame and having type font means thereon, (c) hammer means carried by the frame for movement toward and away from the drum and the type font means thereon during rotation of the drum, (d) an inked ribbon and carrier therefor carried by the frame to feed local ribbon extent between the hammer means and rotating drum, there being ribbon advancing means engaging the ribbon and operable to effect endwise transport of the ribbon onto and off the carrier, (e) print sheet advancing means carried by the frame to advance the sheet endwise between the drum and said local ribbon extent, and (f) drive means operatively connected with the ribbon advancing means and with the sheet advancing means to interruptedly advance the sheet and the ribbon advancing means in response to stroking of the drive means.

As will appear, the print sheet advancing means may include a friction rotor, or rotors at opposite ends of the drum rotating at high speed; and the drive means may include a reciprocating motor such as a drive solenoid and ratchet and pawl mechanism operable to index the print sheet advancing rotors in response to stroking of the motor in one direction. In addition, the ink ribbon carrier is advantageously removably supported on a support unit on the frame in such manner that other ratchet and pawl mechanism is operable to index ribbon advancing means on the carrier in response to stroking of the motor in the opposite direction. Further, the ink ribbon carrier may be shiftable between alternate positions associated with different color printing modes, and for this purpose mechanism may be operatively coupled on the support unit to urge the ink ribbon carrier toward one such position in response to stroking of the drive motor in said one direction. When printing in another color is desired, the support unit may be shifted to alternate position as for example once each cycle of operation of the motor, whereby only one drive is needed.

Additional objects include the provision of a replaceable ribbon carrier or cartridge defining a chamber into which endless ribbon is transported by the advancing means, for storage; the provision of a ribbon drive roller in the cartridge and characterized as having releasable tongue and groove connection with indexing means on the support unit; and the provision of a drum having multiple columns of type font segments, the columns extending in arcs about the drum axis and spaced lengthwise thereof, each column including multiple segments of type characters, the segments spaced about the drum axis; and the provision of thirteen segments in each column and characterized as forming all alphanumeric characters.

These and other objects and advantages of the invention will be more fully understood from the following description and drawings, in which:

DRAWING DESCRIPTION

DETAILED DESCRIPTION

Figures 5, 6, 7:
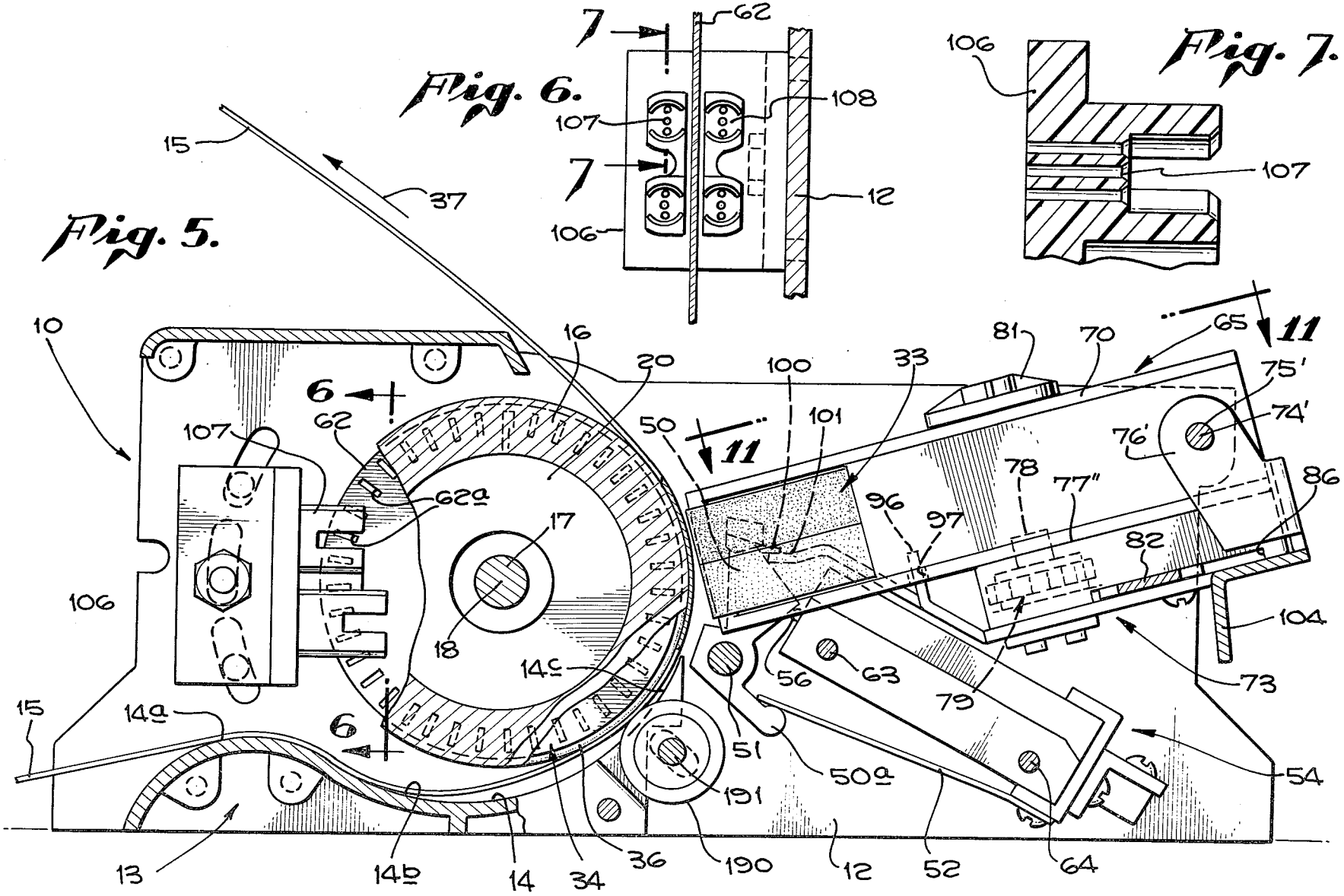
FIG. 5 is a vertical section taken on lines 5—5 of FIG. 2.
FIG. 6 is a vertical section on lines 6—6 of FIG. 5.
FIG. 7 is a section on lines 7—7 of FIG. 6.

As seen in FIGS. 1, 2, 5, 9, 10 and 14, the impact printer apparatus 10 includes a frame such as may advantageously comprise laterally spaced, longitudinally extending, upright plate members 11 and 12. The frame may also be considered to include a paper guide 13 which extends laterally between and interconnects lower portions of the plates. The smooth upper surface 14 of that guide may have S-shape to guide paper strip 15 upwardly at **14*a*, then downwardly at 14*b*, and again upwardly at 14*c*, for travel upwardly in front of drum 16, as best seen in FIG. 5**.

Figures 1, 8:
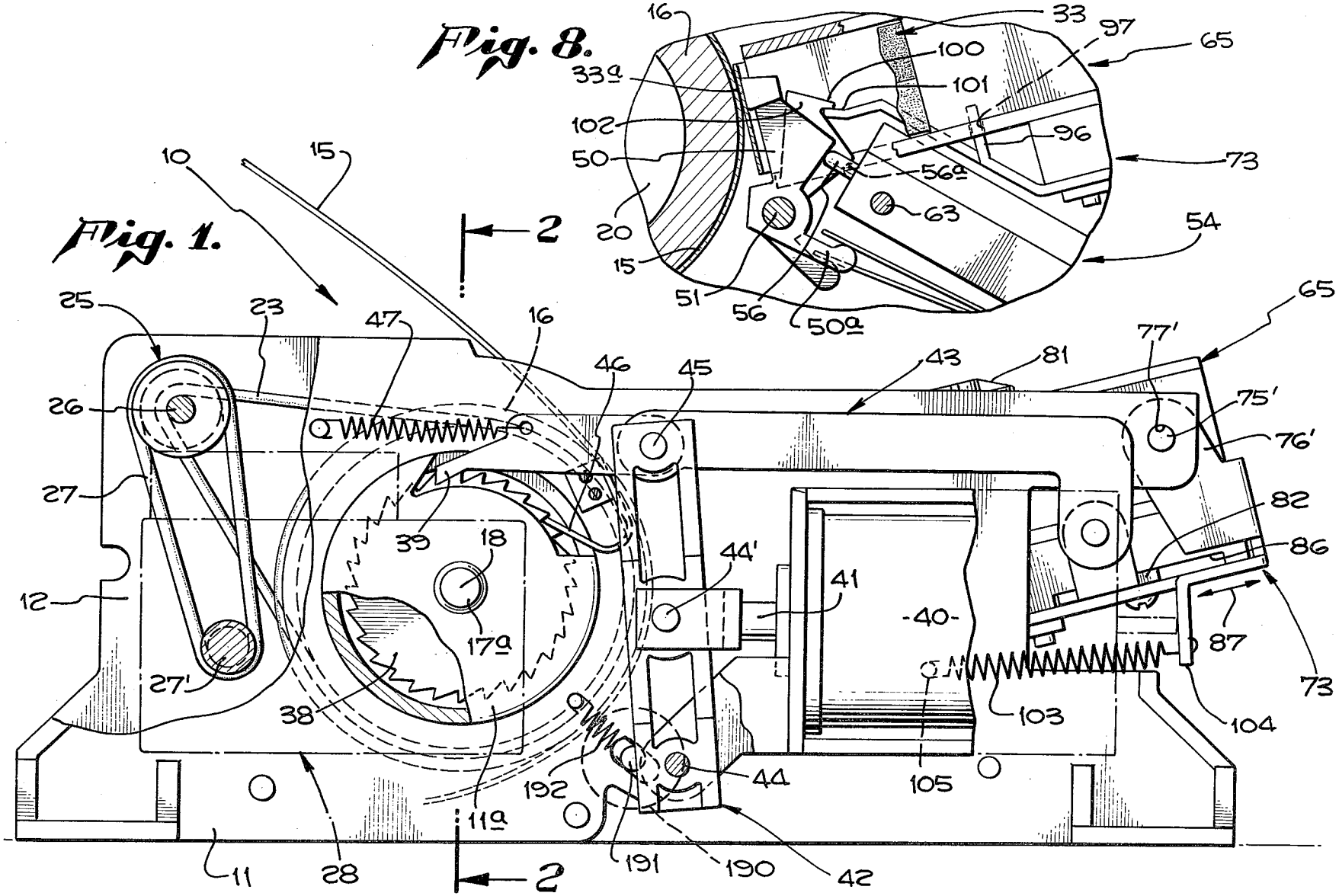
FIG. 1 is a side elevation, partly broken away, showing printer apparatus incorporating the invention.
FIG. 8 is a fragmentary side elevation, partly in section showing hammer operation during printing.
Figure 4:
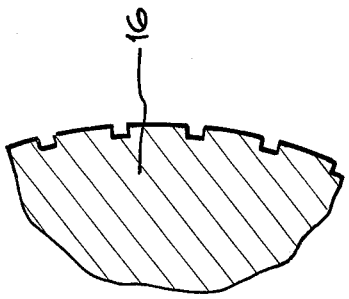
FIG. 4 is an enlarged fragmentary side view of a code wheel appearing in FIG. 2.
Figure 2:
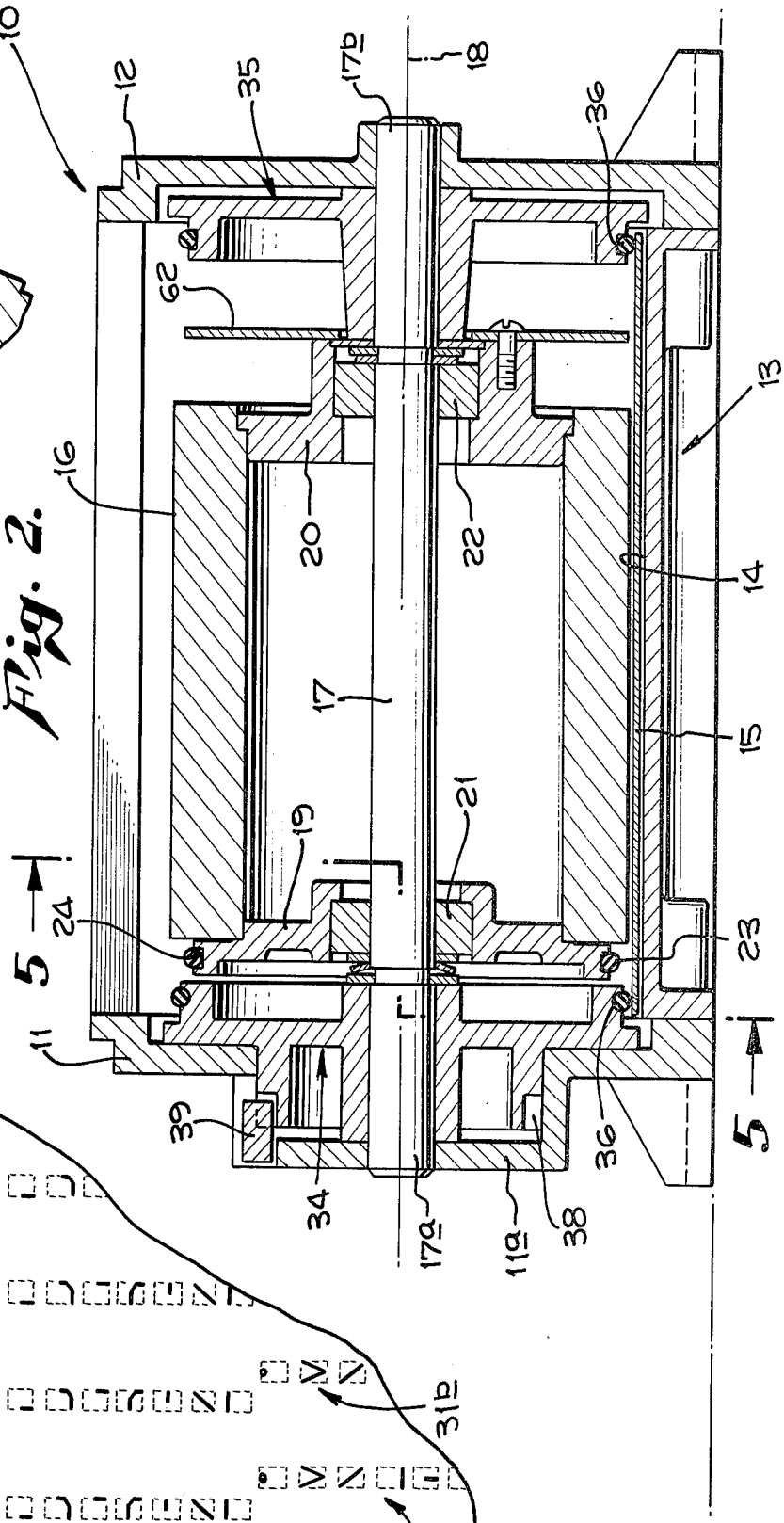
FIG. 2 is a vertical section taken on lines 2—2 of FIG. 1.
Figure 14:
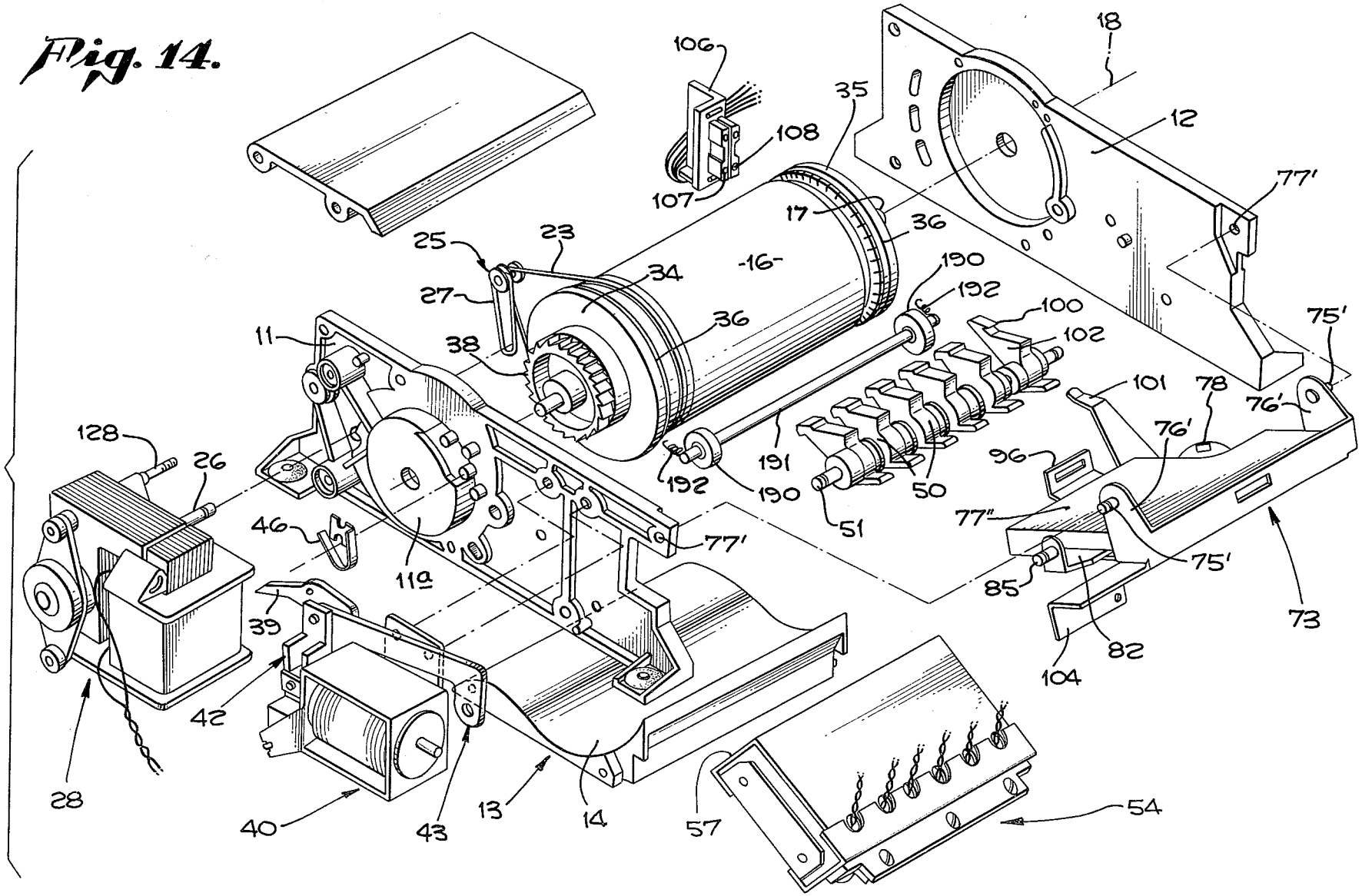
FIG. 14 is an exploded perspective view of the printer mechanism.
Figure 15:
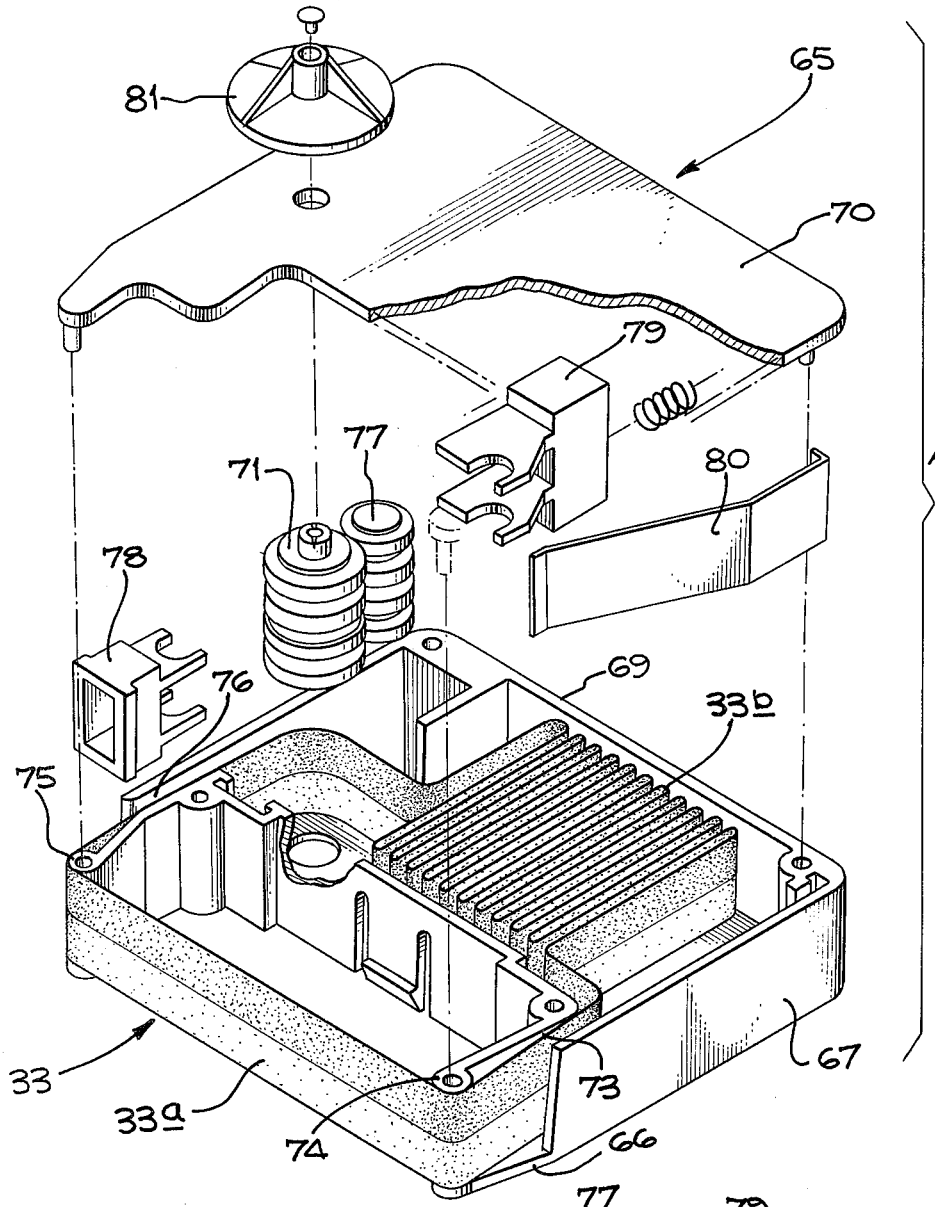
FIG. 15 is an exploded perspective view of the ribbon carrier or cartridge.

Referring to FIG. 2, a laterally extending fixed shaft 17 has its opposite ends **17*a* and 17*b*** journaled by hubs 11*a* and 12*a* integral with the plate members. Drum 16 is mounted on the shaft to freely rotate about shaft axis 18, there being end caps 19 and 20 on the drum and bearings 21 and 22 carried by the caps and journaled on the shaft. Drum rotating means to freely rotate the drum at high speed about shaft 17 includes a drum drive belt 23 entrained in annular groove 24 on the end plate 19, a sheave 25 on auxiliary shaft 26 to also entrain belt 23; and transfer belt 27 also entrained about 25 and about an output shaft 27' of drive motor 28, as seen in FIGS. 1 and 14. Motor 28 is retained to frame member 11 as by bolt 128.

Figure 3:
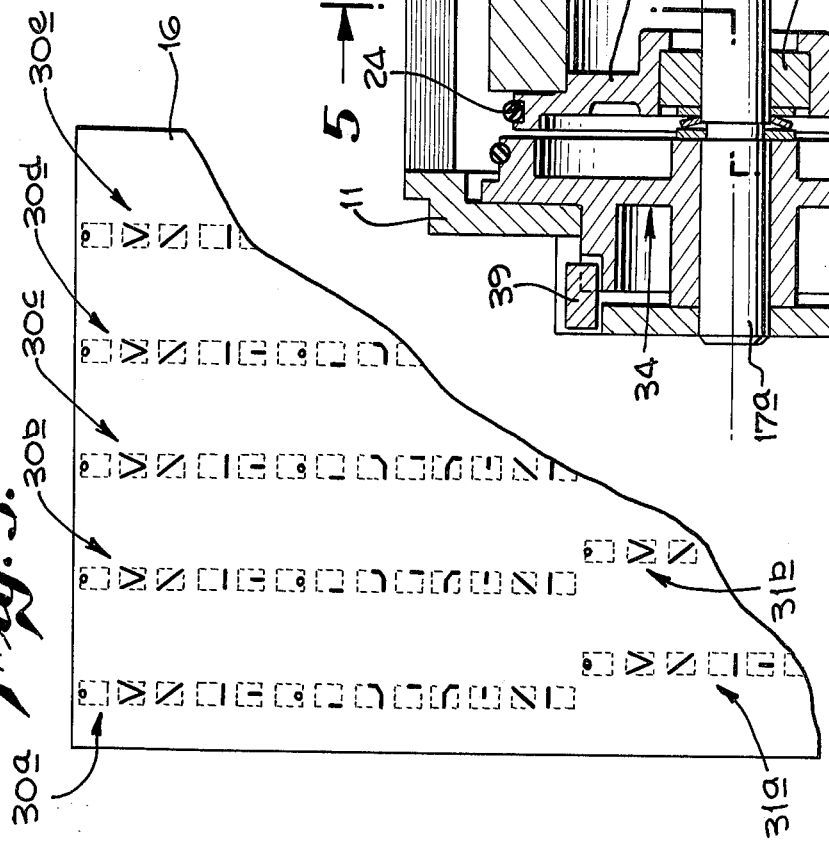
FIG. 3 is a fragmentary developed view of the printer drum.

The drum typically carries at its surface type font means including multiple columns of type segments, the columns extending in arcs about the drum axis and spaced lengthwise thereof. See for example the developed columns 30*a*—30*e* and 31*a*—31*b* in FIG. 3. Successive arc shaped columns about the drum axis, as for example column 30*a* and 31*a*, are relatively shifted along the shaft axis in accordance with the description in U.S. Pat. No. 3,850,097. There are thirteen segments of type in each column shown in FIG. 3, the segments of each column being the same as corresponding segments in the other columns, and capable of selective combination to form all alphanumeric character (the numbers 1 . . . 9, 0, and the letters A . . . Z). Other type segments and column orientations may be employed, but those illustrated are of particular advantage in terms of versatility, speed and compactness.

Print or recording sheet advancing means is provided to advance the sheet endwise between the drum and local lateral extent 33*a* of an inked ribbon 33 as will be described in connection with FIG. 11, the extent 33*a* being subject to indexing advancement endwise. The print sheet advancing means may with unusual advantage include two friction rotors 34 and 35 rotatable about axis 18 and fixidly mounted on the shaft 17 to rotate integrally therewith. Each of the rotors may include a peripheral friction ring, as for example an elastomer O-ring 36 positioned to tangentially and frictionally engage the print sheet 15 to advance same in the direction indicated by arrow 37 in FIG. 5. Note that the O-rings are located to engage opposite edge portions of the sheet 14 and urge same toward smooth guide surface 14 at the front side of the drum. As seen in FIGS. 5 and 14 pressure rollers 190 on a lateral shaft 191 are spring urged at 192 toward the paper at the front side thereof to clamp the paper against the O-rings.

Figure 9:
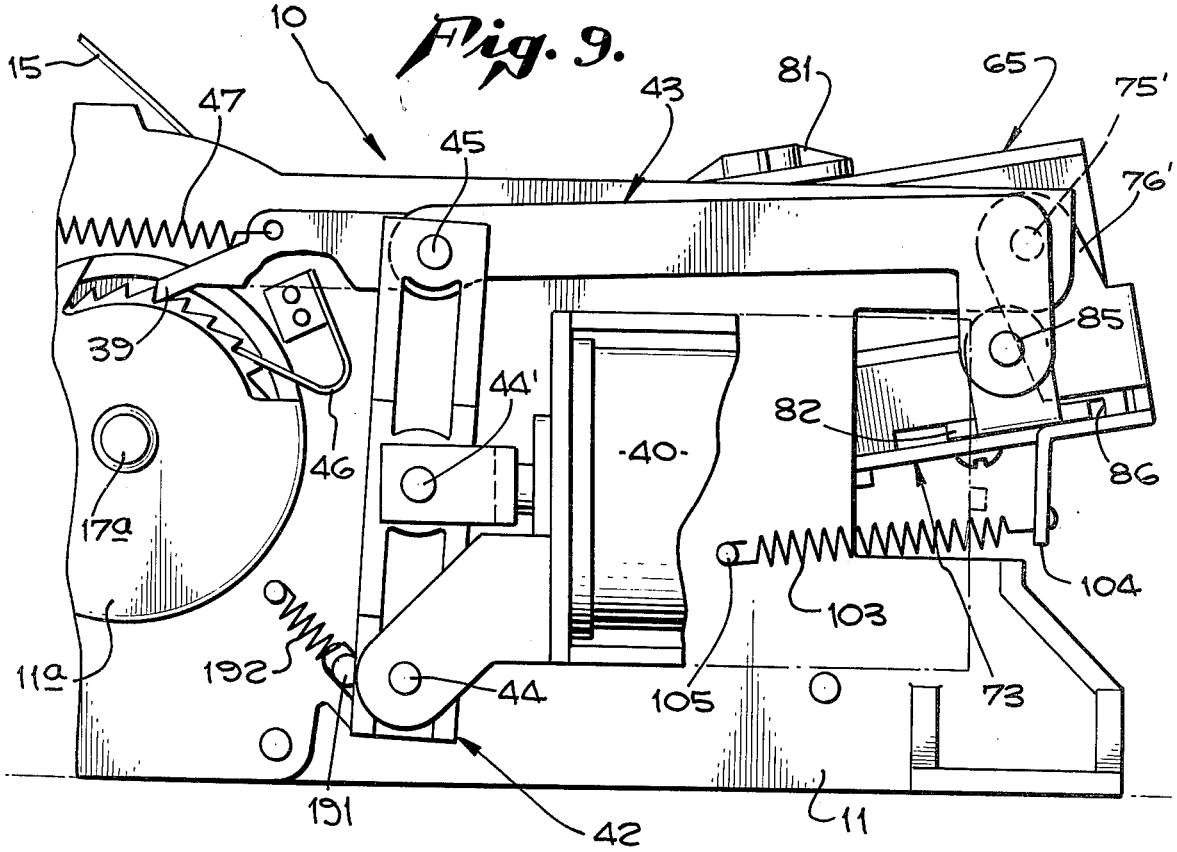
FIG. 9 is a view like FIG. 1, but showing a different working position of the mechanism.

The illustrated drive means also includes a ratchet wheel 38 on rotor 34 and having teeth presented for engagement by pawl 39. The latter is associated with structure operable to interruptedly rotate the wheel 38 and typically includes a reciprocating motor 40 having an output stroke, the pawl subjected to displacement by the motor into and out of rotary indexing relation with the ratchet wheel. The illustrated drive means comprises a solenoid type motor having plunger output at 41 coupled to the pawl via a crank 42 and an actuator arm 43. The crank, pivoted at 44, rotates counterclockwise in FIG. 1 in response to return or leftward stroking of the solenoid plunger, thereby to drive the actuator arm 43 and pawl 39 leftwardly to rotatably index the print sheet advancing means. A pin 44' couples the plunger 41 to the crank 42, and a pin 45 couples the crank to arm 43. FIG. 1 shows the elements in rest position. Powered rightward stroking of the solenoid plunger and rightward travel of arm 43 are resiliently resisted as by extension spring 47, as seen in FIG. 9. Rightward travel of the pawl enables it to cam upwardly on backside of the next tooth of the ratchet wheel and then drop down in front of that tooth to advance it to the left on return stroke. Clockwise rotation of the ratchet wheel is prevented by flat stop spring 46. In this regard, the pawl may also have pivoted connection at 45 to the crank 42 and arm 43. A tension spring 47 is connected between the pawl and frame to continuously urge the pawl, crank and arm 43 to the left.

As seen in FIGS. 5, 8 and 14, hammer means is carried by the frame for movement toward and away from the drum and the type font means thereon during rotation of the drum. Such hammer means may include the multiple like hammers 50 carried on a lateral shaft 51 to pivot thereabout. Flat cantilever springs 52 carried by the frame project rearwardly to engage the upper sides of hammer extension 50*a* to resist drive solenoid selective rotary displacement of the hammers toward the drum, and to return the hammers toward FIG. 5 solid line positions. The hammer actuating solenoid assembly is designated at 54, and includes multiple solenoids including coils 55 and hammer actuating plungers 56 carried in a case 57, as represented in detail in FIG. 17.

The solenoids are electrically connected at 58 to terminals 59, which are in turn connected with electronic control means 60 via cable 61. Control means 60 may be of the type described in U.S. Pat. No. 3,850,097 to selectively energize the solenoids so as to cause the hammers to effect printing of selected type font impressions on the advancing print sheet, the operation being carried out on an "on-the-fly" basis as described in that patent. For that purpose, the drum 16 typically carries a code wheel or timing disc 62 which is scanned by means associated with the control 60 so that the angular positions of the drum and type font thereon in relation to the hammer are accurately tracked at all times. Note that the wheel or disc contains timing slots 62*a* which we subject to counting or scanning as the wheel turns with the drum. The hammer solenoid assembly may be carried by the frame as via connections 63 and 64, and the hammer shaft 51 may also be carried by the frame members 11 and 12.

Referring now to FIGS. 1, 5 and 11–16, an inked ribbon carrier or magazine is provided as at 65, for example, to feed local ribbon extent 33*a* between the hammers and the rotating drum, there also being ribbon advancing means operable to effect endwise transport of the ribbon onto and off the carrier. The carrier may have bottom, side, end and top walls 66–70 and define a chamber into which the ribbon is transported by the advancing means for storage, the ribbon 33 being endless. Note in FIG. 15 the ribbon drive motor 71 rotatable clockwise to store the ribbon in folds 33*b* within the chamber interior. Ribbon is drawn from the last fold through magazine outlet 73, around post 74, and laterally at 33*a* across the face of the drum to be turned by post 75. The ribbon is then drawn into the carrier at 76 by the rotor 71, passing between the latter and a pinch roller 77. Mounting parts for the rotors 71 and 77 are indicated at 78 and 79. A flat spring 80 bears against the ribbon leaving outlet 73 to provide tension keeping the ribbon extent 33*a* taut. An indicator disc 81 on the top of the magazine is coupled to the drive rotor or roller 71 to rotate therewith and indicate that the drive is operating properly.

As shown in FIGS. 5, 10, 11, 12 and 13, the ribbon carrier 65 is removably supported on the frame and in predetermined position against dislodgement from the frame so that the ribbon advancing means, i.e., roller 71, is operatively coupled with the drive means upon placement of the carrier 65 in supported position. For example, a carrier support or shelf unit shown at 73 is pivotally carried by the frame members to rock about a lateral axis 74', pins 75' on the support flanges 76' being pivotally received by openings 77' in the frame members for this purpose. Accordingly, the shelf and supported carrier 65 may rock about axis 74' between FIG. 5 "down" position in which an upper portion (for example black ink) of the ribbon extent **33*a* is presented to be struck by the hammers and compressed against the sheet 15, and FIG. 10 "up" position in which a lower portion (for example red ink) of the ribbon extent 33*a* is presented to be struck by the hammers and compressed against the sheet 15**.

Note in this regard that the carrier 65 is downwardly seated on the shelf unit surface 77'', and that a drive finger 78 integral with a drive ratchet 79' on the shelf unit projects upwardly to removably interfit a slot 80 in the ribbon advancing means roller 71. Besides including the ratchet wheel 79, the drive means may also be considered to include the solenoid 40 previously referred to together with mechanism including pawl 81 engageable with the ratchet wheel to index same in response to stroking of the solenoid plunger 41. As seen in FIG. 11, such mechanism may advantageously include a crank arm 82 pivotally connected at 83 to the shelf unit 73 to swing about upright and rearwardly inclined axis 84, one end of the crank arm 82 connected at 85 to arm 43, and the opposite end of the crank arm 82 connected to pawl 81. Pivoting of arm 43 at 45 accommodates swinging travel of crank arm 82 in slot 86 in the direction of arrows 87, in FIG. 1. Note that ribbon driving ratchet wheel 79 is indexed when the plunger 41 and actuator arm 43 stroke to the right, in FIGS. 1 and 11, whereas the print sheet driving ratchet wheel is indexed when the plunger 41 and arm stroke to the left, providing balanced action and minimum solenoid power requirements.

Figure 11:
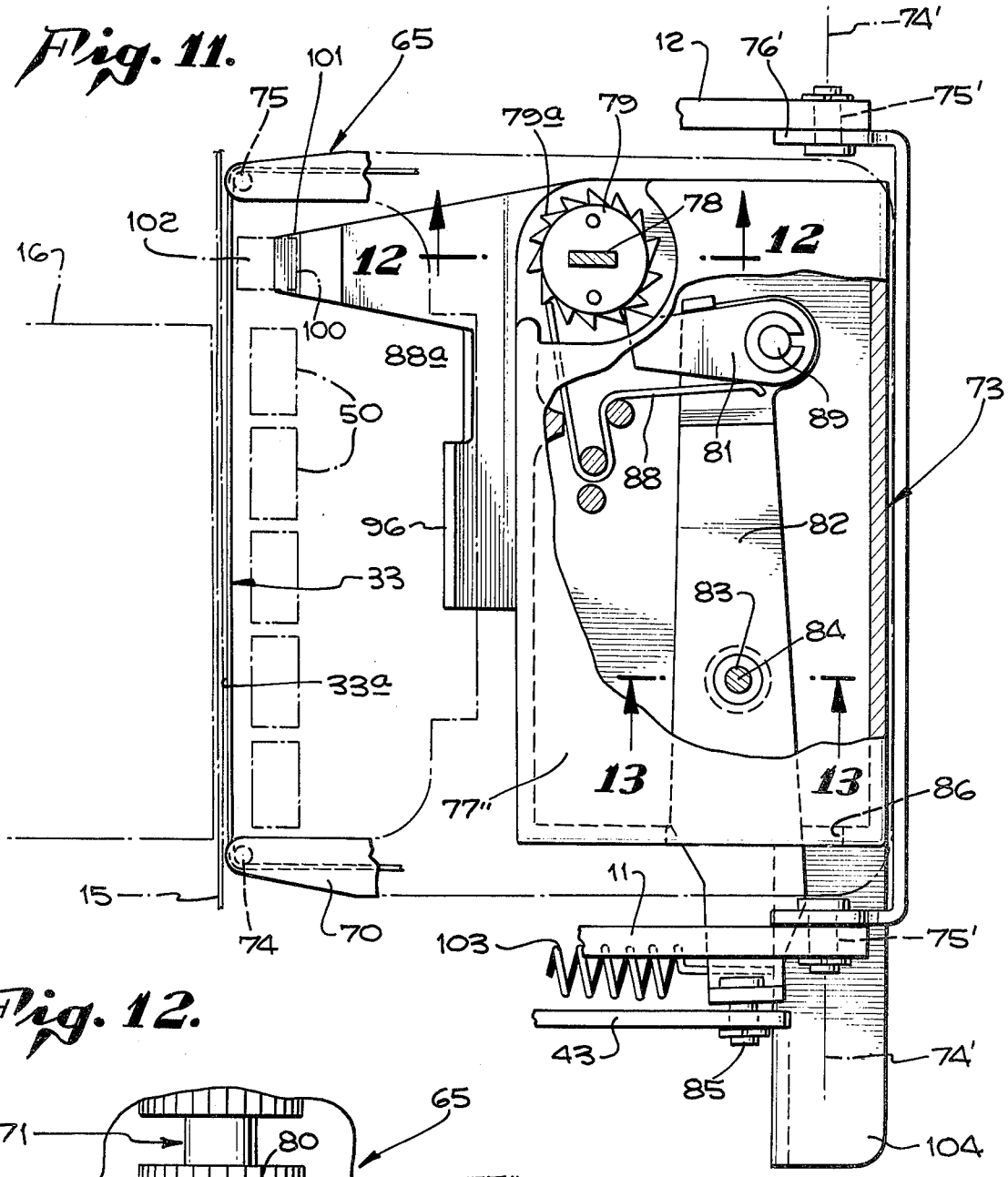
FIG. 11 is a plan view partly broken away and taken on lines 11—11 of FIG. 5.
Figure 12:
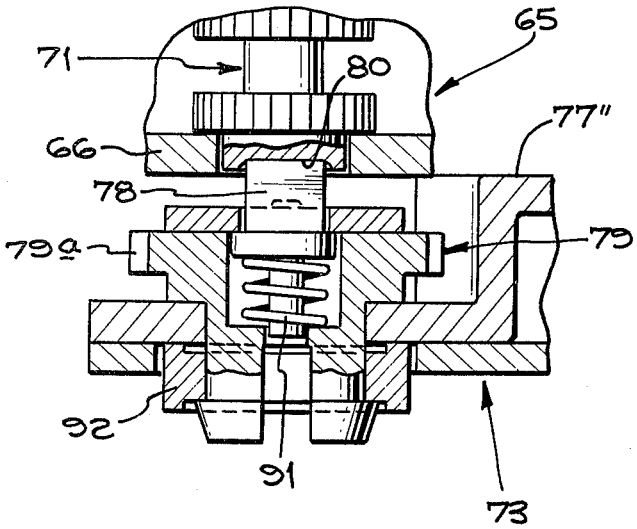
FIG. 12 is an enlarged fragmentary section on lines 12—12 of FIG. 11.
Figure 13:
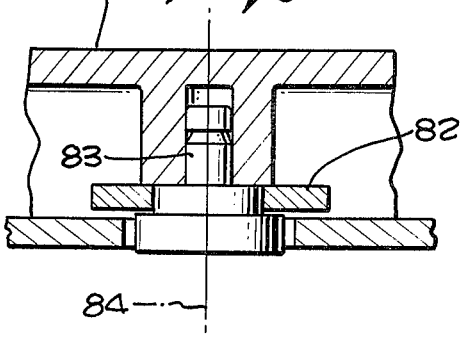
FIG. 13 is an enlarged fragmentary section on lines 13—13 of FIG. 11.

A flat spring 88 seen in FIG. 11 urges the pawl 81 toward the ratchet teeth **79*a*, the pawl being pivotally connected at 89 to crank arm 82. One end 88*a* of the spring extends toward the ratchet teeth to block counterclockwise rotation of the wheel that would otherwise tend to feed ribbon reversely through slot 76 in FIG. 16. In FIG. 12, the coupling finger 78 is shown as carried on a plunger 90 which is urged upwardly by a compression spring 91. Spacer 92** retains the ratchet wheel in position for rotation.

Figure 10:
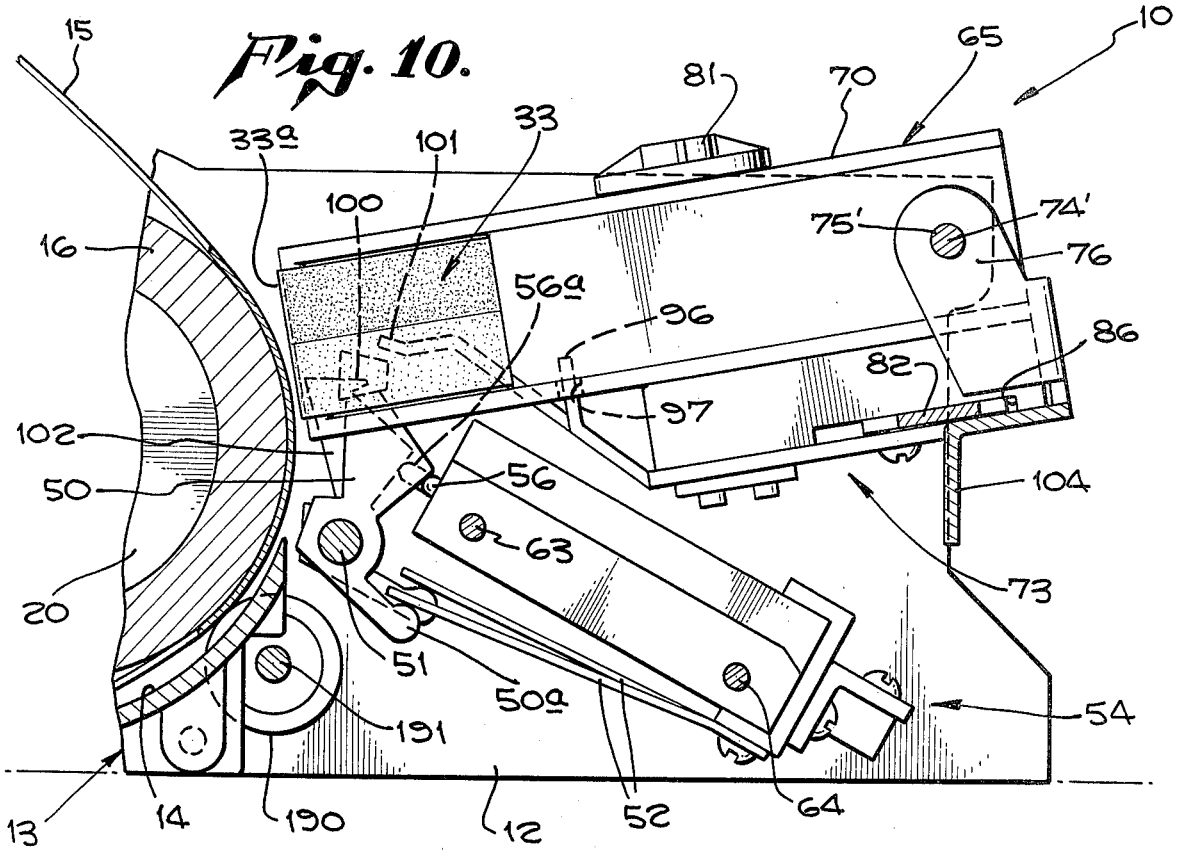
FIG. 10 is a view like FIG. 5 but showing a different working position of the mechanism.

FIGS. 5 and 10 show the provision of a positioning tab 96 carried by the support unit 73 to project upwardly for reception into an opening 97 in the bottom wall of the carrier 65, to position the carrier on the support unit during swinging of the latter.

The apparatus also includes shifting means operatively coupled to the support unit 73 and to the drive means to urge or rock the carrier to the position seen in FIG. 5, in which for example the black ink ribbon is presented to the hammers 50. Such shifting means typically urges the carrier 65 toward FIG. 5 position in response to displacement of the drive means in a predetermined direction. For example, the shifting means may comprise the crank arm 82 seen in FIG. 11, and which when rotated clockwise (i.e. during print strip indexing movement of the plunger 41 and actuator arm in a leftward direction in FIG. 1) acts to rotate the support unit 73 and carrier 65 counterclockwise to FIG. 5 position. Upon arrival at that position, a latch element 100 seen in FIGS. 5 and 14 fits over a tang 101 on the unit 73, for releasably retaining the carrier in that lower position. The tang may cam or snap over the latch to the underside thereof during such carrier movement.

Figure 16:
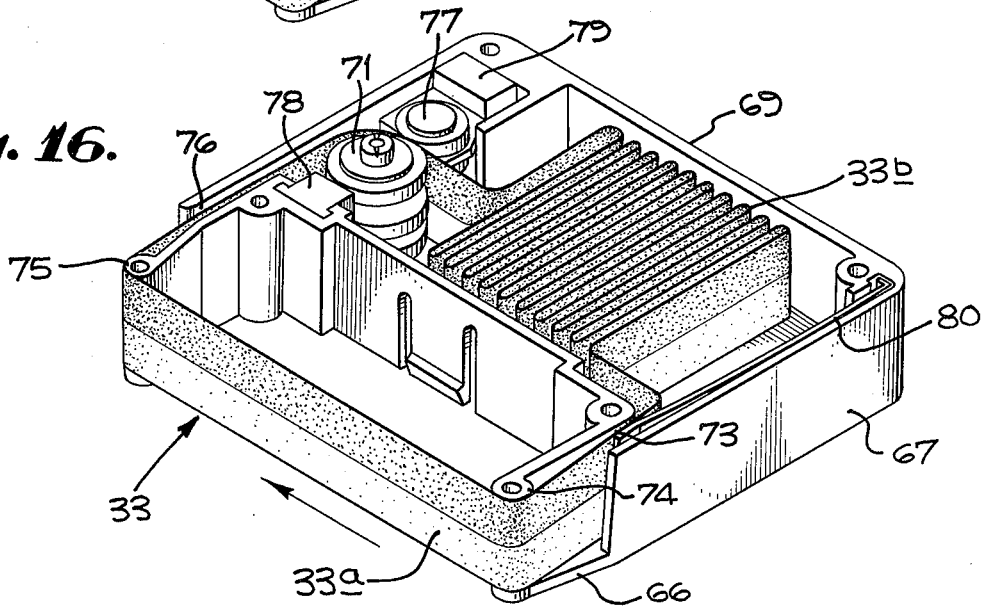
FIG. 16 is an assembled perspective view of the ribbon carrier or cartridge.

Means is also provided to release the latch for unblocking upward movement of the latch to FIG. 10 position, as for example when red character printing is desired, the red ribbon extent being indicated at **33*c* in FIGS. 10 and 16. Such means may comprise an additional solenoid 55*a* in the group of solenoids 55 and having a plunger 56*a* to engage and rotate a swingable arm 102 on hammer shaft 51, that arm carrying the latch 100. Once the latch is swung to release the tang or clog 101, the carrier 73 swings clockwise to FIG. 10 position under the influence of a tension spring 103. The latter is connected between a downwardly extending flange 104 on the carrier and a post 105 on the frame member 11, as seen in FIG. 9. In operation, each print sheet advancing stroke of the drive means tends to shift the carrier and support unit to FIG. 5 position, for black character printing; however, if red printing is desired, then the carrier and support unit are, during each cycle of solenoid operation, released to rotate upwardly to FIG. 10** position. Accordingly, the single solenoid motor and associated drive mechanism have multiple operating functions summarized as follows:

1. Print sheet indexing movement (solenoid plunger moves to the left in FIG. 1)
2. Return of the support unit and ribbon carrier to FIG. 5 position (solenoid plunger moves to the left in FIG. 1).
3. Ribbon indexing movement (solenoid plunger moves to the right, in FIG. 1).

Figure 17:
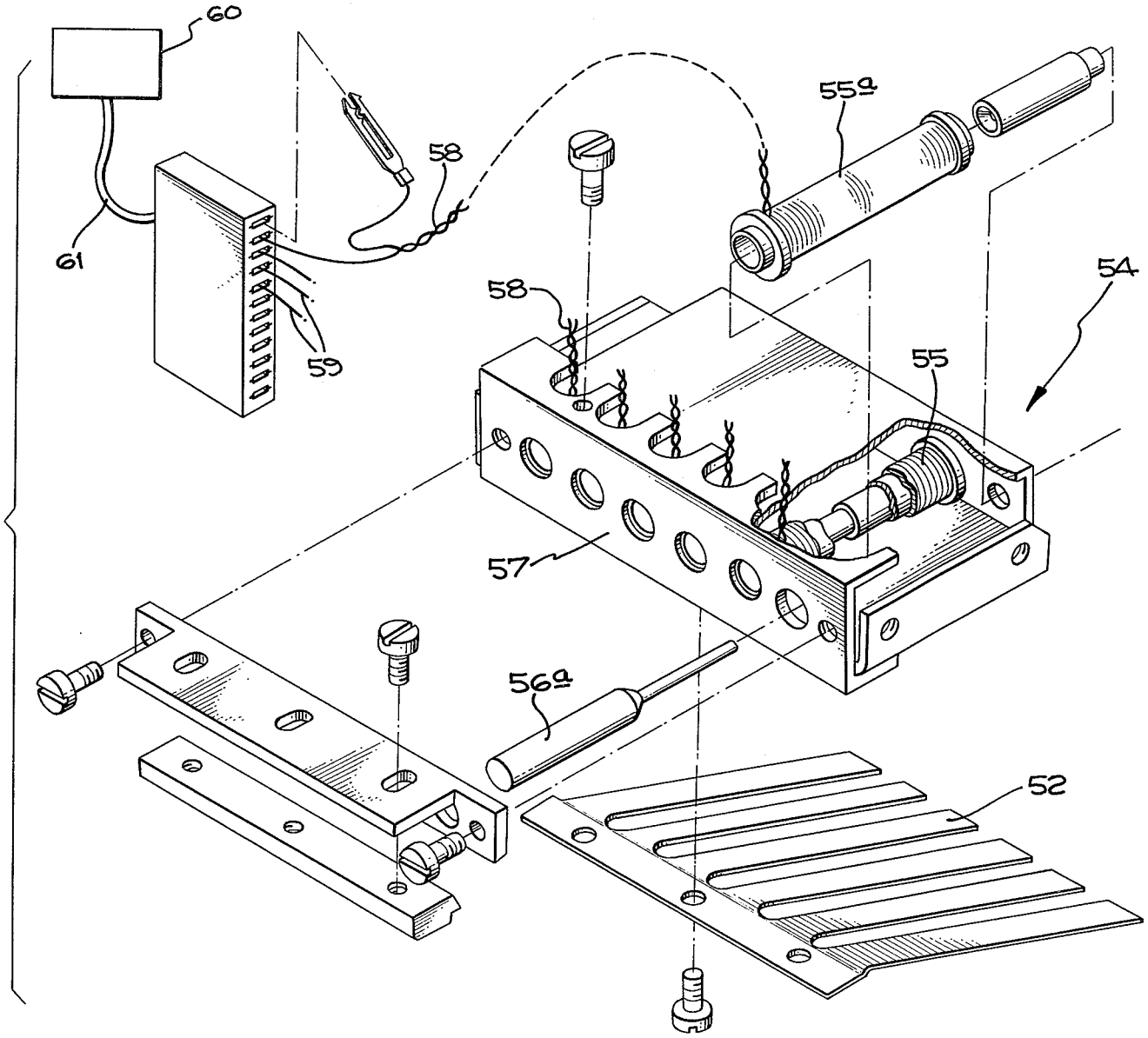
FIG. 17 is a perspective exploded view of hammer mechanism.

Operation of the solenoid to pivot latch arm 102 counterclockwise in FIG. 5 takes place in response to a "red print" electrical signal to that solenoid, as from the control 60 in FIG. 17.

FIGS. 6, 7 and 14 show the provision of means to scan the slots or openings in the timing disc or code wheel 62. Such means may include a block 106 carrying light sources 107 at one side of the disc and photocells 108 at the opposite sides of the disc.

While an ink ribbon has been described in detail, it will be understood that other means to permanently transfer impressions onto the print sheet may be used, as for example NCR paper (in ribbon form), etc.

It should also be observed and recognized that extreme compactness is achieved by locating the drum, hammer assembly, hammer solenoid assembly, ink ribbon carrier and support unit therefor between two parallel frame members 11 and 12, and by locating the drum motor 28 and drive mechanism including solenoid 40 and associated linkage at the outer side of one frame member 11. This in turn facilitates use of the printer in combination with other compact calculation equipment. The manner in which the elements are bolted or retained in assembled condition is further clarified in FIG. 14.

We claim:

1. In compact printer apparatus operable to rapidly print characters on a print sheet in lines and columns, a. a frame, b. a continuously rotating rotary drum carried by the frame and having type font means thereon, c. hammer means carried by the frame for movement toward and away from the drum and the type font means thereon during rotation of the drum, d. an inked ribbon and carrier therefor carried by the frame to feed a local ribbon extent between the hammer means and rotating drum, there being ribbon advancing means engaging the ribbon and operable to effect endwise transport of the ribbon onto and off the carrier, e. print sheet advancing means carried by the frame to advance the sheet endwise between the drum and said local ribbon extent, and f. drive means operatively connected with the ribbon advancing means and with the sheet advancing means to interruptedly advance the sheet and the ribbon advancing means, g. said print sheet advancing means including a sheet advancing friction rotor peripherally and frictionally engageable with the sheet, the drive means including shoulders on the rotor, and pawl means engageable with the shoulders to interruptedly rotatably index the rotor, the frame supporting said friction rotor to rotate independently of but coaxially with said continuously rotating drum at one end thereof, the friction rotor periphery being annular and having a diameter approximately the same as the drum outer diameter.

2. The apparatus of claim 1 wherein said shoulders are on a ratchet wheel and said drive means includes a reciprocating motor connected with the pawl so that the pawl is subjected to displacement by the motor into and out of rotary indexing relation with said ratchet wheel.

3. The apparatus of claim 2 wherein said print sheet advancing means includes a second friction rotor rotatable about said axis at the opposite end of said drum, said second rotor connected with the first mentioned friction rotor to rotate therewith, said rotors including elastomeric O-rings extending about said axis for frictional engagement with the sheet to advance same in proximity to the drum.

4. The apparatus of claim 1 wherein said ink ribbon carrier defines a chamber into which the ribbon is transported by said ribbon advancing means for storage therein, the ribbon being endless.

5. The apparatus of claim 4 in which said ribbon carrier is supported by a support unit on the frame and in predetermined position against dislodgement from the frame, the ribbon advancing means being operatively coupled with said drive means upon placement of the ribbon carrier in said position.

6. The apparatus of claim 5 wherein the support unit has two positions between which it is shiftable relative to the frame and characterized in that in one of said positions a first portion of said ribbon extent is adapted to be compressed between the hammer means and said sheet, and in the second of said positions a second portion of said ribbon extent is adapted to be compressed between the hammer means and said sheet.

7. The apparatus of claim 6 wherein said drive means is coupled with said support unit to displace said support unit between said positions in response to displacement of said drive means.

8. The apparatus of claim 6 wherein the apparatus includes shifting means operatively coupled to the support unit to urge the carrier toward one of said positions in response to displacement of the drive means in a predetermined direction.

9. The apparatus of claim 6 wherein said drive means and said support unit are operatively coupled to displace said support unit from said second position to said first position in response to operation of the drive means.

10. The apparatus of claim 6 wherein said drive means includes a ratchet wheel located on the support unit to have tongue and groove connection with the ribbon advancing means, the drive means further including a solenoid having a plunger, and means including another pawl engageable with the ratchet wheel for indexing said ratchet wheel in response to displacement of said plunger in one direction.

11. The apparatus of claim 10 wherein said drive means includes another ratchet wheel defining said shoulders and carried to rotate in coaxial relation with said drum, and said pawl means engaged with said other ratchet wheel for indexing said other ratchet wheel in response to displacement of said plunger in a direction opposite to said one direction.

12. The apparatus of claim 1 wherein said drive means comprises a single solenoid carried outside and by said frame.

13. The apparatus of claim 1 wherein said drum has an axis and said type font means includes multiple columns of type segments, said columns extending in arcs about the drum axis and spaced lengthwise thereof, each column including multiple segments of type characters, said segments spaced about the drum axis.

14. The apparatus of claim 13 including drum rotating means to continuously rotate the drum and hammer actuators operatively connected with the hammers to selectively displace same toward selected type segments on the drum momentarily presented in alignment with the hammers.

15. The apparatus of claim 14 wherein said shoulders are on a ratchet wheel and said drive means includes a reciprocating motor connected with the pawl so that the pawl is subjected to displacement by the motor into and out of rotary indexing relation with said ratchet wheel, the frame includes laterally spaced, longitudinally extending frame members between which said drum, hammer means and ribbon carrier are positioned, said motor, pawl and ratchet wheel located at the outer side of one of the frame members.

16. The apparatus of claim 1 wherein the frame includes laterally spaced, longitudinally extending frame members between which said drum, hammer means and ribbon carrier are positioned, said drive means including a solenoid located at the outer side of one of said frame members.

* * * * *